US007916882B2

(12) United States Patent
Pedersen et al.

(10) Patent No.: US 7,916,882 B2
(45) Date of Patent: Mar. 29, 2011

(54) HEARING AID WITH AUTOMATIC SWITCHING BETWEEN MODES OF OPERATION

(75) Inventors: Brian Dam Pedersen, Ringsted (DK); Ole Dyrlund Jensen, Virum (DK)

(73) Assignee: GN ReSound A/S (DK)

( * ) Notice: Subject to any disclaimer, the term of this patent is extended or adjusted under 35 U.S.C. 154(b) by 1228 days.

(21) Appl. No.: 11/515,436

(22) Filed: Aug. 31, 2006

(65) Prior Publication Data

US 2007/0121976 A1 May 31, 2007

Related U.S. Application Data

(63) Continuation of application No. PCT/DK2005/000139, filed on Feb. 28, 2005.

(30) Foreign Application Priority Data

Mar. 1, 2004 (DK) ..... 2004 00349

(51) Int. Cl.
*H04R 25/00* (2006.01)

(52) U.S. Cl. ..... 381/313; 381/314

(58) Field of Classification Search ..... 381/313, 381/314

See application file for complete search history.

(56) References Cited

U.S. PATENT DOCUMENTS

| | | | | |
|---|---|---|---|---|
| 2001/0038699 | A1 | 11/2001 | Hou | |
| 2002/0057815 | A1 * | 5/2002 | Killion | 381/313 |
| 2003/0059076 | A1 * | 3/2003 | Martin | 381/331 |

FOREIGN PATENT DOCUMENTS

| | | | |
|---|---|---|---|
| DE | 199 48 907 | A1 | 1/2001 |
| DE | 101 14 101 | A1 | 6/2002 |
| WO | WO 00/05923 | | 2/2000 |
| WO | WO-01/76321 | A1 | 10/2001 |
| WO | PCT/DK2005/000139 | | 2/2005 |

OTHER PUBLICATIONS

B.E. Walden, "Predicting Hearing Aid Microphone Preference in Everyday Listening", J Am Acad Audiol 15:365-396 (2004).

* cited by examiner

*Primary Examiner* — Brian Ensey
(74) *Attorney, Agent, or Firm* — Vista IP Law Group, LLP.

(57) ABSTRACT

The present application relates to a hearing aid, especially a hearing aid with multiple modes of operation and efficient switching between these modes of operation. The hearing aid comprises means for performing a first mode of operation, means for performing a second mode of operation, first and second quality measuring means for providing first and second quality measures corresponding to the first and second modes of operation, respectively, and selecting means for automatically selecting one of said first and second modes of operation by applying a predetermined selection criterion to the first and second quality measures, and wherein the selecting means is programmed to select the mode of operation for which the estimated quality measure is largest when the difference between the first and second quality measures exceeds a predetermined threshold value.

34 Claims, 5 Drawing Sheets

HEARING AID WITH AUTOMATIC SWITCHING BETWEEN MODES OF OPERATION

RELATED APPLICATIONS

This application is a continuation of PCT Application No. PCT/DK2005/000139, which was filed on 28 Feb. 2005, now expired, which claims priority from Danish Patent Application No. PA 2004 00349 filed on 1 Mar. 2004, the disclosures of both of these applications are expressly incorporated by reference in their entirety herein.

TECHNICAL FIELD

The application relates to a hearing aid, especially a hearing aid with multiple modes of operation and efficient switching between these modes of operation.

BACKGROUND

It is well known in the art of hearing aids to have multiple modes of operation, such as different directional characteristics and different methods of noise suppression. The purpose of the different modes of operation is to suit the wearer's needs as good as possible in different environments and situations. As an example, directionality makes it possible for a hearing aid to "focus" on a sound source, such as a speaking person, located e.g. in front of the wearer of the hearing aid. Thereby, possibly disturbing sounds coming from the sides and back of the wearer will have a limited influence on the wearer's perception of sound from a source in front of him/her.

Since it is quite inconvenient for a hearing impaired person to manually switch between different modes of operation in dependence of his/her needs, several attempts have been made to develop efficient methods for automatically selecting "the best" mode of operation as the listening environment or conditions changes. See e.g. published international patent application WO 01/76321 for an example of this.

Another example of such an automatic selection algorithm was presented by Starkey Laboratories, Inc. at the Union der Hörgeräte-Akustiker (UHA) fair in Nürnberg (Germany) in October, 2003. It was stated that "the omni-directional mode is activated in environments with good signal to noise ratio and the directional mode is activated in environments with poor signal to noise ratio".

Recently, research has shown that hearing aid users prefer a directional mode of operation over an omni-directional mode primarily when they find themselves in a noisy environment and there is a speech source in front of them at a fairly close range, e.g. 2-3 meters. These research results was presented on 1 Feb. 2003 by Brian E. Walden, Ph.D., Director of Research, Army Audiology & Speech Center, Walter Reed Army Medical Center at The First Annual Southern California Conference on Speech, Language, And Hearing Sciences under the title: "Predicting Hearing Aid Microphone Preference in Everyday Listening".

SUMMARY

It is an object to provide an efficient and user friendly system and method for switching between modes of operation in a hearing aid.

Thus, in a first aspect, a hearing aid is provided that comprises means for performing a first mode of operation, means for performing a second mode of operation, first and second quality measuring means for providing first and second quality measures corresponding to the first and second modes of operation, respectively, and selecting means for automatically selecting one of said first and second modes of operation by applying a predetermined selection criterion to the first and second quality measures.

Preferably, the first mode of operation is an omni-directional mode of operation and the second mode of operation is a directional mode of operation. This means that in the first mode of operation, a wearer of the hearing aid will hear sound originating from all directions equally well, more or less, while in the directional mode, the wearer will hear sound coming from a certain direction, such as straight in front of him/her, much better than sound coming from other directions. Thus, the means for performing the first mode of operation may comprise an omni-directional microphone and the means for performing the second mode of operation may comprise a directional microphone. The latter may be a separate directional microphone unit or be composed of the omni-directional microphone in combination with a second omni-directional microphone.

Preferably, the first and second quality measuring means may comprise means for measuring first and second signal-to-noise ratios, respectively. Thereby, a signal-to-noise ratio is provided for each of the two modes of operation Alternatively, the first and second quality measuring means may comprise means for measuring first and second modulation depths, respectively. The modulation depth could be measured by continuously tracking maximum and minimum in the signal amplitudes in each of the two modes of operation. The modulation depth is to be understood as the difference between the maximum and minimum amplitude when measuring over suitable time intervals, such as intervals with a length of 1 ms, such as 5 ms, such as 20 ms, such as 50 ms, such as 0.1 s, such as 0.25 s, such as 0.5 s, such as 1 s. In common situations where the noise level is substantially constant over the time interval, the modulation depth will thus provide an indication of the signal strength of faster varying signals, such as speech, relative to the static or quasi-static noise level.

Yet alternatively, the first and second quality measuring means may comprise first and second speech detectors, respectively, for providing respective first and second probabilities of speech being present in the respective modes of operation. Such speech detectors are well known in the art. The probability of speech thus provides a measure of how "speech-like" a signal is according to the speech detector. Thus, if the first mode of operation is an omni-directional mode and the second mode of operation is a directional mode, and the wearer of the hearing aid is facing a speaking person while a lot of noise is coming from a location e.g. behind the wearer, the probability of speech provided by the first speech detector will be significantly lower than the probability provided by the second speech detector.

Preferably, the selecting means is programmed to select the mode of operation for which the estimated quality measure is largest when the difference between the first and second quality measures exceeds a predetermined threshold value. The threshold ensures that the selecting means does not switch between the modes of operation until a certain improvement in the quality measure is achieved by doing so. The threshold value may be a difference in signal-to-noise ratio or modulation depth of 1 dB, such as 1.5 dB, such as 2 dB, such as 2.5 dB, such as 3 dB, such as 3.5 dB, such as 4 dB, such as 4.5 dB, such as 5 dB, such as 6 dB, such as 8 dB, such as 10 dB, such as 12 dB. Alternatively, the threshold value may be an absolute difference in speech probability of 0.1, such as 0.15, such as 0.2, such as 0.25, or a relative difference of 5%, such as 10%, such as 15%. Furthermore, the threshold value may be dependent of the absolute level of the quality measures in the sense that the threshold may be larger at high quality measure levels than at low quality measure levels. Thus, if the quality measure of the first mode of operation is high, such as a signal-to-noise ratio of 9 dB, the threshold value may be 6 dB, while in the case of a low quality measure of the first mode of operation, such as 2 dB, the threshold value may be only 1.5 dB. This way, the second mode of operation will only be selected when it provides a substantial improvement in the quality measure.

Preferably, the selecting means is programmed to stay in a selected mode of operation for at least a predetermined minimum period of time. This ensures that the selecting means will not switch back and forth when the difference between the two quality measures is just around the threshold value. The minimum period of time may be as long as 1 ms, such as 5 ms, such as 20 ms, such as 50 ms, such as 0.1 s, such as 0.25 s, such as 0.5 s, such as 1 s, such as 2 s, such as 5 s, such as 10 s.

Preferably, the first quality measuring means comprises a noise detector for providing a noise level, the second quality measuring means comprises a speech detector for estimating a speech probability, and the selecting means is programmed to select the second mode of operation when the noise level exceeds a predetermined noise level threshold and said speech probability exceeds a predetermined probability threshold. Otherwise, the first mode of operation will be selected.

The noise level and probability thresholds may be set to standard values based e.g. on experience of audiologists, but may also be set individually in accordance with feedback from the wearer of the hearing aid.

Furthermore, the first and second quality measuring means may be arranged to operate simultaneously and independent of one another. This assures that the hearing aid may always operate in the currently most user-preferable mode.

In a second aspect, a method for controlling the operation of a hearing aid having at least a first and a second mode of operation is provided. The method comprises estimating a first quality measure relating to the first mode of operation, estimating a second quality measure relating to the second mode of operation, and selecting a mode of operation based on at least said first and second quality measures.

Preferably, the first mode of operation is an omni-directional mode of operation and the second mode of operation is a directional mode of operation.

The first and second quality measures may comprise first and second signal-to-noise ratios, respectively. Alternatively, the first and second quality measures may comprise first and second modulation depths, respectively. As a further alternative, the first and second quality measures may comprise first and second speech probabilities, respectively, provided by respective first and second speech detectors.

Preferably, the step of selecting is further based on a difference between the first and second quality measures. The step of selecting preferably results in selection of the mode of operation for which the estimated quality measure is largest when the difference between the first and second quality measures exceeds a predetermined threshold value.

Furthermore, the step of selecting may be constrained to stay in a selected mode for at least a predetermined minimum period of time.

Preferably, the first quality measure is a noise level provided by a noise detector, the second quality measure is a speech probability provided by a speech detector, and the step of selecting results in the second mode of operation when said noise level exceeds a predetermined noise level threshold and said speech probability exceeds a predetermined speech probability threshold.

In a third aspect, a program is provided for performing the method of the second aspect in a digital signal processing unit of a hearing aid.

In a fourth aspect, a computer readable data carrier is provided that is loaded with a program according to the third aspect.

The embodiments will now be described in further detail with reference to the accompanying drawings.

DETAILED DESCRIPTION OF THE DRAWINGS

Figure 1:
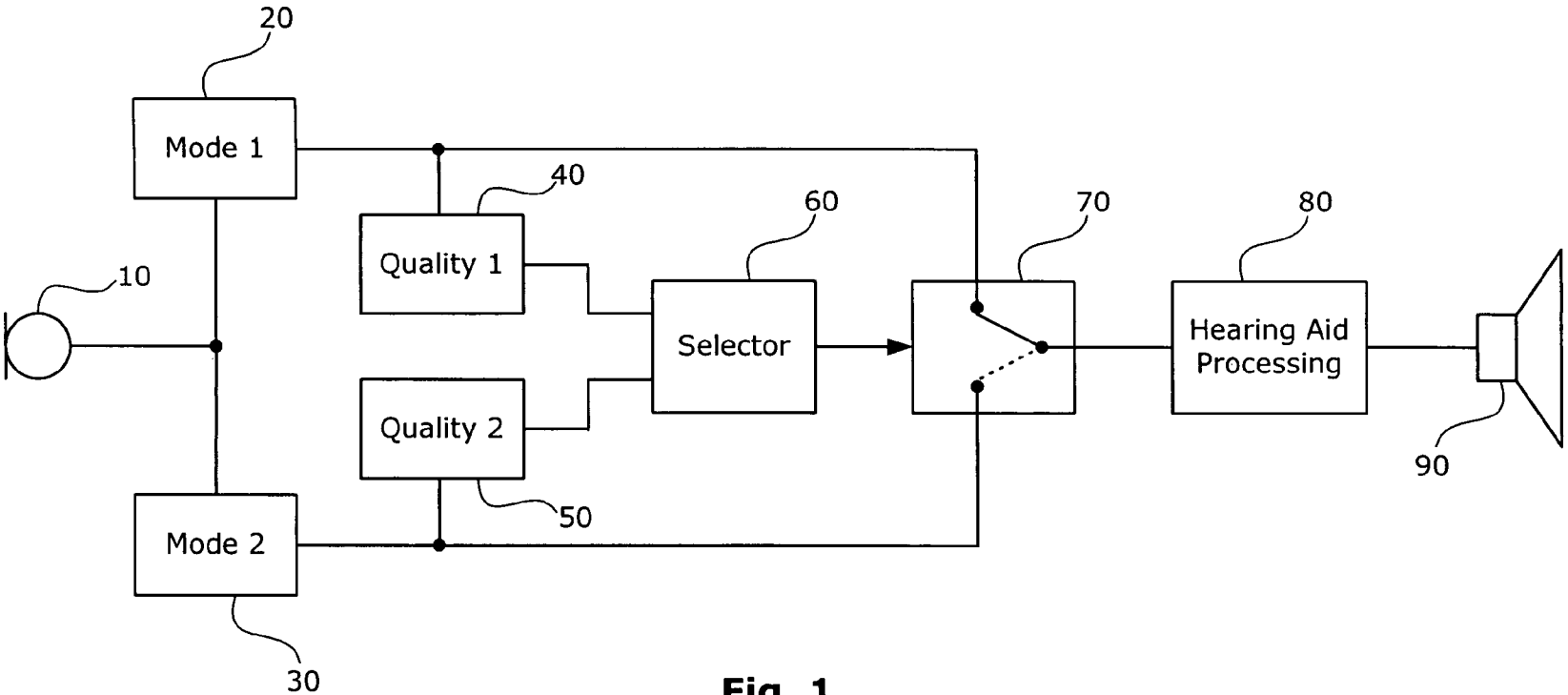
FIG. 1 shows a block diagram of a hearing aid with a system for switching between two modes of operation.

In FIG. 1, the general principle of a hearing aid according to the present embodiment is shown as a block diagram. Sound is picked up by the microphone 10 and distributed to the blocks 20 and 30. The block 20 applies a first mode of processing, Mode 1, to the sound signal from the microphone 10. The processed signal is fed to the first quality estimator 40 and to the switch 70. The quality estimator 40 generates a first quality measure, Quality 1, and feeds it to the selector 60. Similarly, the block 30 applies a second mode of processing, Mode 2, to the sound signal from the microphone 10. The processed signal is fed to the second quality estimator 50 and to the switch 70. The second quality estimator 50 generates a second quality measure, Quality 2, and feeds it to the selector 60. The selector 60 applies a selection criterion to the received quality measures, Quality 1 and Quality 2, and as a result controls the switch 70 to feed the signal processed either in 20 (Mode 1) or in 30 (Mode 2) to the hearing aid processor 80. After processing in the processor 80, the signal is emitted by means of the loudspeaker or receiver 90.

Figure 2:
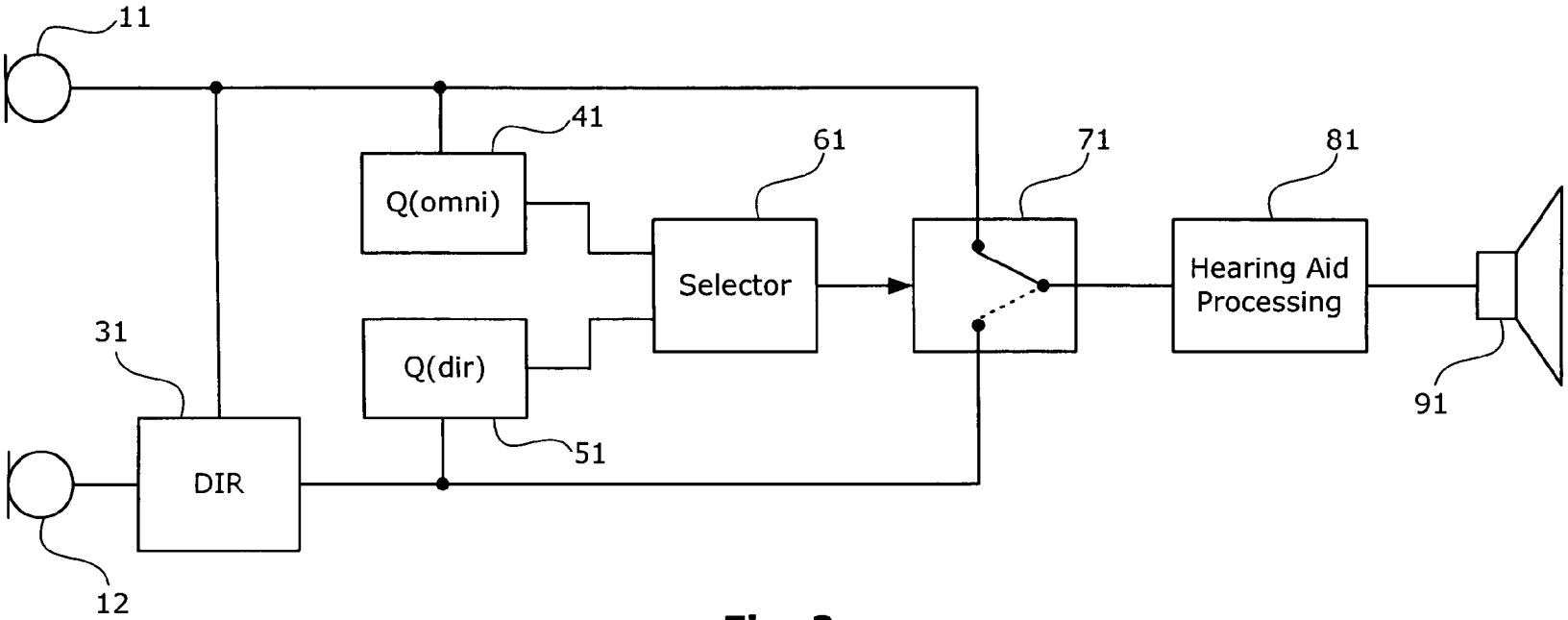
FIG. 2 shows a block diagram of a hearing aid with a system for switching between an omni-directional and a directional mode of operation.

FIG. 2 shows a block diagram of a preferred embodiment. Sound is picked up by microphones 11 and 12, which are both omni-directional microphones suitable for use in a hearing aid. The sound signal from the microphone 11 is fed to the quality estimator 41 and to the switch 71. The quality estimator 41 generates a quality measure Q(omni) based on the (omni-directional) sound signal from the microphone 11 and feeds it to the selector 61. The sound signal from the microphone 11 is also fed to the directional unit 31, which further receives a sound signal from the microphone 12 and combines the two sound signals to form a directional sound signal. The construction of the directional unit 31 and how the microphones 11 and 12 should be placed relative to one another in order to achieve a desired effect of directionality is well known for a skilled person and will accordingly not be described in further detail here. The directional sound signal is fed to the quality estimator 51 and to the switch 71. The quality estimator 51 generates a quality measure Q(dir) based on the directional sound signal from the directional unit 31 and feeds it to the selector 61. The selector 61 evaluates the two quality measures Q(omni) and Q(dir) and controls the switch 71 to feed either the omni-directional signal from 11 or the directional signal from 31 to the hearing aid processor 81, which may include compressors, amplifiers and filters suitable for hearing aid sound processing. After processing in the processor 81, the final signal is emitted by means of the receiver 91.

The purpose of the quality estimators 41 and 51 is to provide comparable measures relating to the quality of performance that a hearing impaired wearer of the hearing aid will experience in both of the two modes. The estimators can be implemented in a number of ways. A first possibility is to measure the modulation depth in the two modes. In order to do this, the quality estimators 41 and 51 should continuously track maximum and minimum in their respective signal amplitudes. The modulation depth is then provided by calculating the difference between the maximum and minimum amplitude in suitable time intervals, such as intervals with a length of 1 ms, such as 5 ms, such as 20 ms, such as 50 ms, such as 0.1 s, such as 0.25 s, such as 0.5 s, such as 1 s. In many situations, the noise level will appear to be substantially constant over the time interval, and the modulation depth will thus provide an indication of the signal strength of faster varying signals, such as speech, relative to the noise level.

Another possible implementation of the quality estimators 41 and 51 comprises a speech detector in each quality estimator 41, 51. The output from the speech detectors is probabilities of speech being present in the respective mode of operation, i.e. a numerical value between 0 and 1 indicating how "speech-like" the signal is according to the speech detector. Thus, if the wearer of the hearing aid is facing a speaking person while a lot of noise is coming from another location, e.g. behind the wearer, the probability of speech provided by the speech detector in 41 will be significantly lower than the probability provided by the speech detector in 51, i.e. Q(omni)<Q(dir). This corresponds to the observation that the wearer of a hearing aid in this situation will usually prefer the directional mode in order to better hear and understand the speaking person.

Figure 3:
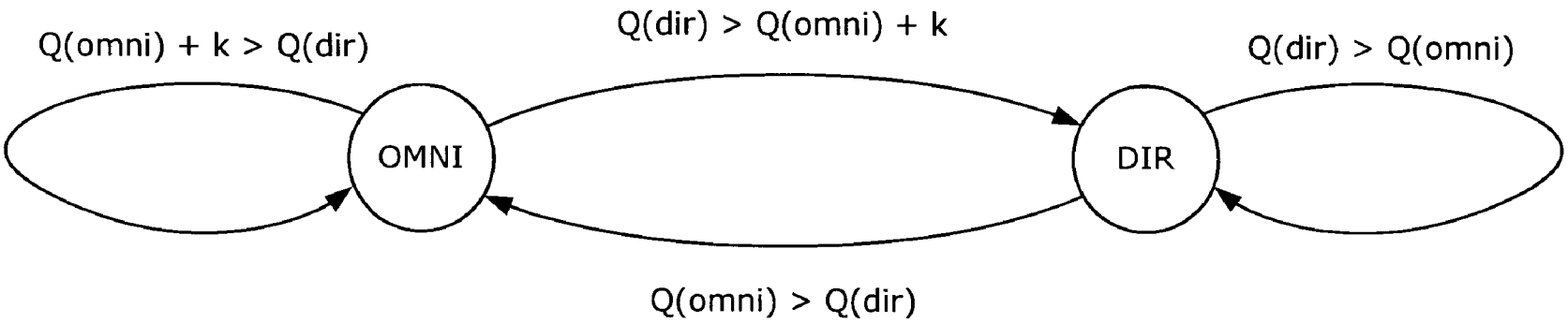
FIG. 3 is a state diagram showing a scheme for selecting between omni- and directional modes of operation.

The selector 61 automatically selects the currently most preferable mode of operation in accordance with a predetermined (possibly user defined) criterion. This can be done in a number of ways. FIG. 3 shows one example in the form of a state diagram. When the hearing aid is in the omni-directional mode, the selector 61 will not change the switch 71 to directional mode until Q(dir)>Q(omni)+k, i.e. until the quality measure of the directional mode exceeds the quality measure of the omni-directional mode with at least k, a threshold value. When the hearing aid is in the directional mode, the selector 61 will change the switch 71 to omni-directional mode when Q(omni)>Q(dir), i.e. there is no threshold for the shift from directional to omni-directional mode.

The threshold value k ensures that the selector 61 does not switch to the directional mode until a certain improvement in the quality will be experienced by a user.

The threshold value k may be a difference in modulation depth of 1 dB, such as 1.5 dB, such as 2 dB, such as 2.5 dB, such as 3 dB, such as 3.5 dB, such as 4 dB, such as 4.5 dB, such as 5 dB, such as 6 dB, such as 8 dB, such as 10 dB, such as 12 dB. Alternatively, the threshold value k may be an absolute difference in speech probability of 0.1, such as 0.15, such as 0.2, such as 0.25, or a relative difference of 5%, such as 10%, such as 15%. Furthermore, the threshold value k may be dependent of the absolute level of the quality measures in the sense that the threshold may be larger at high quality measure levels than at low quality measure levels. Thus, if the quality measure of the omni-directional mode of operation is high, such as a modulation depth of 9 dB, the threshold value may be 6 dB, while in the case of a low quality measure of the omni-directional mode of operation, such as 2 dB, the threshold value may be only 1.5 dB. This way, the directional mode of operation will only be selected when it provides a substantial improvement in the quality measure.

Figure 4:
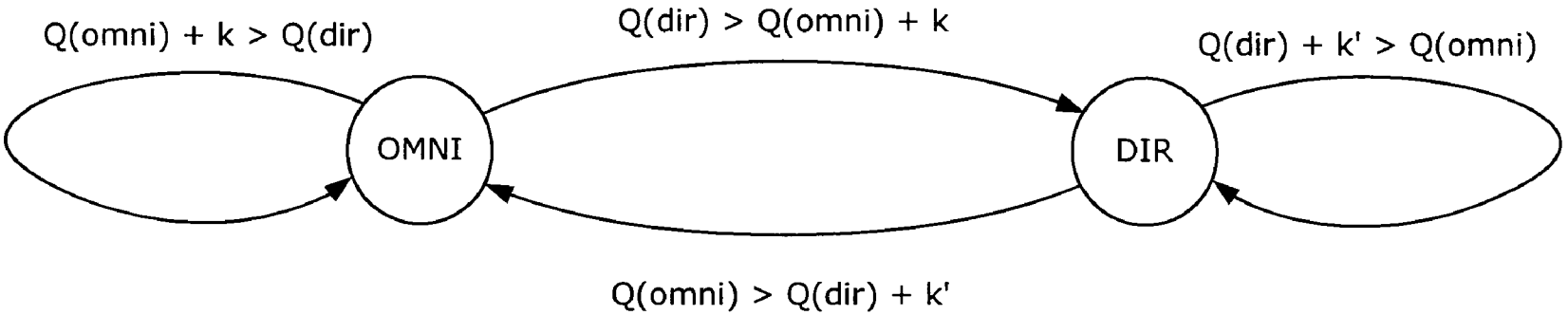
FIG. 4 is a state diagram showing a further scheme for selecting between omni- and directional modes of operation.

In FIG. 4, a threshold value, k', is added in comparison to the scheme shown in FIG. 3. Now, when in the directional mode, Q(omni) must exceed Q(dir)+k' before the selector 61 changes the switch 71 to the omni-directional mode.

In order to avoid rapid shifting back and forth between the omni-directional and directional modes, the selector may be programmed to stay in a selected mode of operation for at least a predetermined minimum period of time. This ensures that the selecting means will not switch back and forth when the difference between the two quality measures is just around the threshold value. The minimum period of time may be 1 ms, such as 5 ms, such as 20 ms, such as 50 ms, such as 0.1 s, such as 0.25 s, such as 0.5 s, such as 1 s, such as 2 s, such as 5 s, such as 10 s.

To best suit the individual wearer's needs, it may be beneficial to involve the user in setting the threshold values k and k', as well as the above mentioned minimum period of time.

Figure 5:
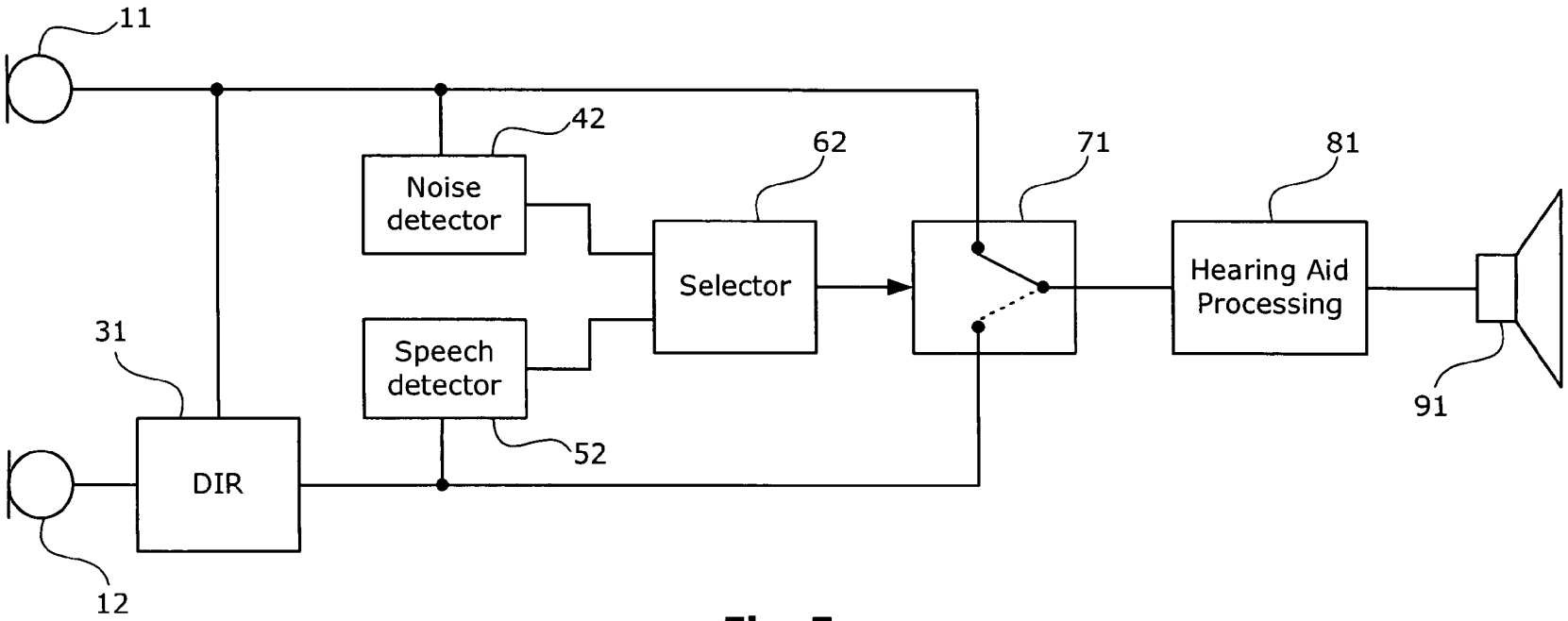
FIG. 5 shows a block diagram of a hearing aid with a system for switching between an omni-directional and a directional mode of operation based on a noise level measured in omni-directional mode and a speech probability detected in directional mode.

FIG. 5 shows a further preferred embodiment, which differ from the above described in that a noise detector 42 and a speech detector 52 replace items 41 and 51, respectively. The noise detector 42 provides a level of noise measured in the omni-directional mode and the speech detector 52 provides a speech probability measured in the directional mode. The level of noise and the speech probability are both fed to the selector 62, which replaces the selector 61 of the previous embodiment. In this embodiment, the directional mode of operation is selected when the noise level exceeds a predetermined minimum noise level and, at the same time, the speech probability exceeds a predetermined minimum speech probability.

The invention claimed is:

1. A hearing aid comprising:

means for performing a first mode of operation, means for performing a second mode of operation, first and second quality measuring means for providing first and second quality measures corresponding to the first and second modes of operation, respectively, and selecting means for automatically selecting one of said first and second modes of operation by applying a predetermined selection criterion, wherein the selecting means is configured to select the one of said first and second modes of operation for which the corresponding quality measure is largest when a difference between the first and second quality measures exceeds a predetermined threshold value.

2. The hearing aid according to claim 1, wherein the first mode of operation is an omni-directional mode of operation and the second mode of operation is a directional mode of operation.

3. The hearing aid according to claim 1, wherein the first and second quality measuring means comprise means for measuring first and second signal-to-noise ratios, respectively.

4. The hearing aid according to claim 1, wherein the first and second quality measuring means comprise means for measuring first and second modulation depths, respectively.

5. The hearing aid according to claim 1, wherein the first and second quality measuring means comprise first and second speech detectors, respectively, for providing respective first and second probabilities of speech being present in the respective first and second modes of operation.

6. The hearing aid according to claim 1, wherein the selecting means is configured to stay in the selected mode of operation for at least a predetermined minimum period of time.

7. The hearing aid according to claim 1, wherein the first and second quality measuring means are arranged to operate simultaneously and independent of one another.

8. The hearing aid of claim 1, wherein the predetermined threshold value is larger than zero.

9. The hearing aid of claim 1, wherein the selecting means is configured to select the one of the first and second modes of operation when the difference between the first and second quality measures exceeds the predetermined threshold value such that the selection means does not switch between the first and second modes of operation until a certain level of improvement in one of the quality measures relative to the other one of the quality measures is achieved.

10. A hearing aid comprising:

means for performing a first mode of operation;

means for performing a second mode of operation;

first and second quality measuring means for providing first and second quality measures corresponding to the first and second modes of operation, respectively; and selecting means for automatically selecting one of said first and second modes of operation by applying a predetermined selection criterion;

wherein the selecting means is configured to select the one of said first and second modes of operation for which the corresponding quality measure is largest when a difference between the first and second quality measures exceeds a predetermined threshold value; and wherein the first quality measuring means comprises a noise detector for providing a noise level, the second quality measuring means comprises a speech detector for estimating a speech probability, and the selecting means is configured to select the second mode of operation when said noise level exceeds a predetermined noise level threshold and said speech probability exceeds a predetermined probability threshold.

11. A method for controlling an operation of a hearing aid, said hearing aid having at least a first and a second mode of operation, the method comprising:

estimating a first quality measure relating to the first mode of operation, estimating a second quality measure relating to the second mode of operation, and selecting one of the first and second modes of operation for which the corresponding estimated quality measure is largest when a difference between the first and second quality measures exceeds a predetermined threshold value.

12. The method according to claim 11, wherein the first mode of operation is an omni-directional mode of operation and the second mode of operation is a directional mode of operation.

13. The method according to claim 11, wherein the first and second quality measures comprise first and second signal-to-noise ratios, respectively.

14. The method according to claim 11, wherein the first and second quality measures comprise first and second modulation depths, respectively.

15. The method according to claim 11, wherein the first and second quality measures comprise first and second speech probabilities, respectively, provided by respective first and second speech detectors.

16. The method according to claim 11, wherein the selected mode is maintained for at least a predetermined minimum period of time.

17. The method of claim 11, wherein the predetermined threshold value is larger than zero.

18. The method of claim 11, wherein the act of selecting is performed such that a switching between the first and second modes of operation is not performed until a certain level of improvement in one of the quality measures relative to the other one of the quality measures is achieved.

19. A method for controlling an operation of a hearing aid, said hearing aid having at least a first and a second mode of operation, the method comprising:

estimating a first quality measure relating to the first mode of operation;

estimating a second quality measure relating to the second mode of operation, and selecting a mode of operation based on at least said first and second quality measures for which the estimated quality measure is largest when the difference between the first and second quality measures exceeds a predetermined threshold value;

wherein the first mode of operation is an omni-directional mode of operation and the second mode of operation is a directional mode of operation; and wherein the first quality measure is a noise level provided by a noise detector, the second quality measure is a speech probability provided by a speech detector, and the step of selecting results in the second mode of operation when said noise level exceeds a predetermined noise level threshold and said speech probability exceeds a predetermined speech probability threshold.

20. A system for controlling an operation of a hearing aid, said hearing aid having at least a first and a second mode of operation, the system comprising:

means for estimating a first quality measure relating to the first mode of operation, means for estimating a second quality measure relating to the second mode of operation, and means for selecting one of the first and second modes of operation for which the corresponding estimated quality measure is largest when a difference between the first and second quality measures exceeds a predetermined threshold value.

21. The system of claim 20, wherein the predetermined threshold value is larger than zero.

22. The system of claim 20, wherein the means for selecting is configured to select one of the first and second modes of operation when the difference between the first and second quality measures exceeds the predetermined threshold value such that the means for selecting does not switch between the first and second modes of operation until a certain level of improvement in one of the quality measures relative to the other one of the quality measures is achieved.

23. A product having a set of instructions stored in a non-transitory medium, wherein an execution of the instructions causes a method for controlling an operation of a hearing aid to be performed, said hearing aid having at least a first mode and a second mode of operation, the method comprising:

estimating a first quality measure relating to the first mode of operation;

estimating a second quality measure relating to the second mode of operation; and selecting one of the first and second modes of operation for which the corresponding estimated quality measure is largest when a difference between the first and second quality measures exceeds a predetermined threshold value.

24. The product of claim 23, wherein the first mode of operation is an omni-directional mode of operation and the second mode of operation is a directional mode of operation.

25. The product of claim 23, wherein the first quality measure is a noise level provided by a noise detector, the second quality measure is a speech probability provided by a speech detector, and the act of selecting results in the second mode of operation when said noise level exceeds a predetermined noise level threshold and said speech probability exceeds a predetermined speech probability threshold.

26. An apparatus for controlling an operation of a hearing aid, the hearing aid having at least a first mode and a second mode of operation, the apparatus comprising:

a processing component configured for determining a first quality measure relating to the first mode of operation, determining a second quality measure relating to the second mode of operation, and selecting one of the first and second modes of operation for which the corresponding estimated quality measure is largest when a difference between the first and second quality measures exceeds a predetermined threshold value.

27. The apparatus of claim 26, wherein the first mode of operation is an omni-directional mode of operation and the second mode of operation is a directional mode of operation.

28. The apparatus of claim 26, wherein the processing component is configured for determining the first and second quality measures by measuring first and second signal-to-noise ratios, respectively.

29. The apparatus of claim 26, wherein the processing component is configured for determining the first and second quality measures by measuring first and second modulation depths, respectively.

30. The apparatus of claim 26, wherein the processing component comprises first and second speech detectors for providing respective first and second probabilities of speech being present in the respective first and second modes of operation.

31. The apparatus of claim 26, wherein the processing component is configured to maintain the selected mode of operation for at least a predetermined minimum period of time.

32. The apparatus of claim 26, wherein the processing component comprises a first subcomponent for determining the first quality measure and a second subcomponent for determining the second quality measure, and wherein the first and second subcomponents are configured to operate simultaneously and independent of one another.

33. The apparatus of claim 26, wherein the predetermined threshold value is larger than zero.

34. The apparatus of claim 26, wherein the processor is configured to select one of the first and second modes of operation when the difference between the first and second quality measures exceeds the predetermined threshold value such that the processor does not switch between the first and second modes of operation until a certain level of improvement in one of the quality measures relative to the other one of the quality measures is achieved.

* * * * *